US008148310B2

(12) United States Patent
Lee

(10) Patent No.: US 8,148,310 B2
(45) Date of Patent: Apr. 3, 2012

(54) COMPOSITION AND METHOD FOR CLEANING SEMICONDUCTOR SUBSTRATES COMPRISING AN ALKYL DIPHOSPHONIC ACID

(76) Inventor: Wai Mun Lee, Milpitas, CA (US)

( * ) Notice: Subject to any disclaimer, the term of this patent is extended or adjusted under 35 U.S.C. 154(b) by 0 days.

(21) Appl. No.: 12/888,569

(22) Filed: Sep. 23, 2010

(65) Prior Publication Data

US 2011/0098205 A1 Apr. 28, 2011

Related U.S. Application Data

(60) Provisional application No. 61/254,669, filed on Oct. 24, 2009.

(51) Int. Cl.
*C11D 7/36* (2006.01)

(52) U.S. Cl. ..... 510/175; 510/222; 510/228; 510/253; 510/254; 510/258; 510/431; 510/436; 510/467; 134/1.2; 134/1.3

(58) Field of Classification Search ..... 510/175, 510/222, 228, 253, 254, 258, 431, 436, 467; 134/1.2, 1.3
See application file for complete search history.

(56) References Cited

U.S. PATENT DOCUMENTS 4,711,724 A * 12/1987 Johnson ..... 210/699
4,802,990 A * 2/1989 Inskeep, Jr. ..... 210/699
4,806,259 A * 2/1989 Amjad ..... 510/162
6,143,705 A 11/2000 Kakizawa
6,310,019 B1 10/2001 Kakizawa
6,395,693 B1 5/2002 Wang
6,410,494 B2 6/2002 Kakizawa
6,440,856 B1 8/2002 Bessho
6,514,921 B1 2/2003 Kakizawa
6,534,458 B1 3/2003 Kakizawa
6,541,434 B2 4/2003 Wang
6,716,803 B2 4/2004 Kakizawa
7,250,391 B2 * 7/2007 Kanno et al. ..... 510/175
7,312,186 B2 12/2007 Takashima
7,621,281 B2 11/2009 Ikemoto
2001/0051597 A1 12/2001 Kato
2004/0161933 A1 * 8/2004 Takashima et al. ..... 438/689
2005/0090104 A1 * 4/2005 Yang et al. ..... 438/689
2006/0276366 A1 * 12/2006 Deljosevic et al. ..... 510/302
2006/0293199 A1 * 12/2006 Tamura et al. ..... 510/175
2007/0090094 A1 * 4/2007 Thompson et al. ..... 216/89
2009/0099051 A1 * 4/2009 Aoyama et al. ..... 510/176
2011/0065622 A1 * 3/2011 Lee et al. ..... 510/176

* cited by examiner

*Primary Examiner* — Charles Boyer

(57) ABSTRACT

The compositions and methods herein relate to the method for the removal of residues and contaminants from metal or dielectric surfaces. Particularly, a composition and method of cleaning residues after chemical mechanical polishing of a copper or aluminum surface of the semiconductor substrates. A method of cleaning semiconductor substrates comprising contacting the substrates with a solution of water, and sufficient amount of alkyl diphosphonic acid comprising alkyl diphosphonic acid selected from the group of 1 hydroxyethane 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane 1,1 diphosphonic acid, 1-hydroxy-4-aminobutane 1,1 diphosphonic acid mixed with dodecylbenzenesulfonic acid, xylenesulfonic acid, toluenesulfonic acid, phosphonoformic acid, sulfamic acid, 2-amino ethane sulfonic acid, or fluoroboric acid or an organic carboxylic acid and pH is adjusted to from greater than 6 to about 10 with a metal ion free base, and a surfactant.

9 Claims, No Drawings

COMPOSITION AND METHOD FOR CLEANING SEMICONDUCTOR SUBSTRATES COMPRISING AN ALKYL DIPHOSPHONIC ACID

RELATED APPLICATIONS

This application claims the priority of U.S. provisional patent application 61/254,669 filed Oct. 24, 2009.

FIELD OF THE INVENTION

The present invention relates to compositions and methods for removal of chemical residues from metal or dielectric surfaces or for chemical mechanical polishing of a copper or aluminum surface including an aqueous solution comprising an alkyl disphosphonic acid compound applied for a time sufficient to remove the chemical residues.

BACKGROUND OF THE INVENTION

U.S. Pat. Nos. 6,143,705, 6,310,019, 6,440,856, 6,514,352, 6,514,921, 6,534,458, 6,541,434, 6,716,803, 7,250,391, 7,312,186, and 7,541,322 discuss various compositions and methods of cleaning semiconductor substrates containing phosphonic acids.

U.S. Pat. Nos. 6,395,693 and 6,541,434 describe a method and composition for cleaning contaminants from the surface of a semiconductor wafer after the semiconductor wafer has been chemically-mechanically polished, the method comprising contacting the surface of the semiconductor wafer having abrasive particle and metal ion contaminants with a composition comprising carboxylic acid is present in an amount of about 2 wt. % or less, said amine-containing compound is present in an amount of about 0.1 wt. % or less, and said phosphonic acid is present in an amount of about 2 wt. % or less. The cleaning composition desirably has a pH of about 4-6. Preferably, the cleaning composition has a pH of about 4.5-5.5. The weight ratio of phosphonic acid to carboxylic acid is 1:1.

U.S. Patent Application No. 200110051597 discusses an aqueous solution of a citric acid concentration of more than 1 vol. %, and the chelating agent is added into the aqueous solution containing the citric acid by 10 ppm or more. The weight ratio of phosphonic acid to carboxylic acid, such is 1:1000 (i.e., 10 ppm of phosphonic acid to 1% citric acid).

Phosphonic acid, in particular 1-hydroxyethane 1,1-diphosphonic acid (commonly termed HEDPA) has been in commercial use for many years as a corrosion inhibitor and as a complex agent. It is well understood when HEDPA is used in quantities less than 30 parts to million parts water, it acts as corrosion inhibitor. Above 150 parts to million parts water, it acts as a chelating agent. In the range 30-150 parts HEDPA to one million parts water there is a dead zone; the HEDPA does not perform.

SUMMARY OF THE INVENTION

The present invention relates to composition and method for cleaning semiconductor substrates. The invention has particular application as a residues and particles remover in semiconductor manufacturing processes and the like.

One embodiment encompassed is a cleaning solution that contains an alkyl diphosphonic acid of the basic structure:

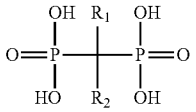

wherein $R_1$ and $R_2$ are either the same or different and select from the group consisting of hydrogen (H), hydroxide (OH), chloride (Cl), alkyl or aryl having between 1 to about 8 carbon atoms and alkyl or aryl amine. Some compositions contain a second acidic compound, a buffering amount of one or more metal ion free basic compounds to adjust pH from greater than 6 to about 10, optionally from 0% by weight and up to 5% by weight of a surfactant, and a balance of water.

The compositions encompassed may have a mole ratio of alkyl diphosphonic acid to a second acidic compound, or compounds, of about 1:1 to about 10:1.

Preferred alkyl disphosphonic acids are 1-hydroxyethane, 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane, 1 diphosphonic acid, 1-hydroxy-4-aminobutane, 1,1 diphosphonic acid, and mixtures thereof.

Where the composition contains a second acid, that second acid may, for example, be dodecylbenzenesulfonic acid, xylenesulfonic acid, toluenesulfonic acid, phosphonoformic acid, sulfamic acid, 2-amino ethane sulfonic acid, or fluoroboric acid or an organic carboxylic acid. The composition may also contain an organic carboxylic acid.

Where the composition contains an organic carboxylic acid, that acid may be oxalic acid, lactic acid, citric acid, formic acid, tartaric acid, propionic acid, benzoic acid, ascorbic acid, gluconic acid, malic acid, malonic acid, succinic acid, gallic acid, butyric acid, trifluoracetic acid and mixtures thereof.

It is also contemplated that the compositions may include a buffering basic compounds, such as potassium hydroxide, sodium hydroxide and metal ion free base. Where the compositions contain such a compound or mixture of compounds.

The metal ion free basic compound or mixture may be at least one basic compounds consisting of hydroxylamine free-base or a hydroxylamine derivative, tetraalkylammonium hydroxide (TMAH), tetraalkylammonium hydroxide pentahydrate (TMAH pentahydrate), Benzyltetramethylammonium hydroxide (BTMAH), tetrabutylammonium hydroxide (TBAH), choline hydroxide, or tris(2-hydroxyethyl)methylammonium hydroxide (THEMAH), monoethanolamine, 2(2-hydroxylethylamino)ethanol, 2-(2-aminoethoxy)ethanol, N,N,N-tris(2-hydroxyethyl)-ammonia, isopropanolamine, 3-amino-1-propanol, 2-amino-1-propanol, 2-(N-methylamino)ethanol, 2-(2 aminoethylamino)ethanol, tris (hydroxymethyl)aminoethane, or mixtures thereof.

A preferred pH range is from greater than 6 to about 10.

Surfactants may also be used in the compositions encompassed herein. Preferred surfactants include nonionic, anionic, cationic, and/or amphoteric, polyacrylic acid or its water soluble salts, or hydrolyzed poly-maleic anhydride or its water soluble salts and the like.

In some applications the compositions may be diluted with DI water at dilution ratios, for example, of up to 1:10, up to 1:50, up to 1:100, up to 1:150, up to 1:250, and up to about 1:500 or any ratios therein. HEDPA combined with a surfactant produces a synergistic result. The surfactant not only functions as a dispersant but also improves the residue dissolving performance of the HEDPA when the HEDPA is used in strength above 150 parts to million parts water.

One method of using the compositions described herein involves providing a substrate having a surface comprising copper-containing conductor and a low-k dielectric material and one or more of resist, etching residue, planarization residue, and copper oxide disposed on the surface, which generated from a damascene or dual damascene manufacturing processes or thereof; contacting the surface of the substrate with an effective amount of solution comprising alkyl diphosphonic acid of the basic structure:

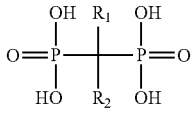

wherein $R_1$ and $R_2$ are either the same or different and select from the group consisting of hydrogen (H), hydroxide (OH), chloride (Cl), alkyl or aryl having between 1 to about 8 carbon atoms and alkyl or aryl amine, adding a second acidic compound and a buffering amount of basic compounds to adjust pH from greater than 6 to about 10, optionally including from 0% by weight and up to 5% by weight of a surfactant, with a balance of water. This composition is contacted with a substrate for a time and at a temperature sufficient to remove the resist, residues, and/or copper oxide. The preferred temperature for the method, is from about ambient to about 70° C., more preferably about 50° C., and the preferred contact time is between about 10 seconds and about 30 minutes. The compositions described herein may be used in a cleaning process following a chemical mechanical planarization step during the semiconductor fabrication process, as well as other appropriate cleaning processes known to one of skill in the art.

DETAILED DESCRIPTION OF THE INVENTION

The present invention relates to the provision of an improved cleaning solution which is a blend of alkyl diphosphonic acid and a second acidic substance at a mole ratio of about 1:1 to about 10:1 in water.

The alkyl diphosphonic acid of the basic structure:

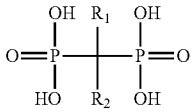

wherein $R_1$ and $R_2$ are either the same or different and select from the group consisting of hydrogen (H), hydroxide (OH), chloride (Cl), alkyl or aryl having between 1 to about 8 carbon atoms and alkyl or aryl amine.

Examples of the alkyl diphosphonic acids are as follow:

| Name | $R_1$ | $R_2$ | Structure |
|---|---|---|---|
| 1-hydroxyethane 1,1 diphosphonic acid | OH | $CH_3$ | 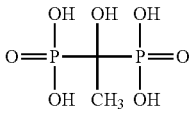 |
| Methylene diphosphonic acid (MDP) | H | H | 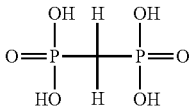 |
| Hydroxymethylene diphosphonic acid (HMDP) | OH | H | 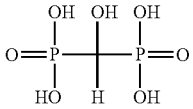 |
| Dichloromethylene diphosphonic acid ($Cl_2$MDP) | Cl | Cl | 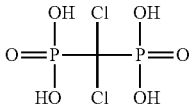 |
| Hydroxylcyclohexylmethylene diphosphonic acid (HCMDP) | OH | 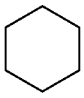 | 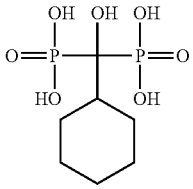 |

-continued

| Name | $R_1$ | $R_2$ | Structure |
|---|---|---|---|
| 1-hydroxy-3-aminopropane 1,1 diphosphonic acid (APD) | OH | $—CH_2CH_2NH_2$ | 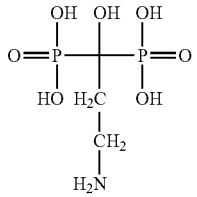 |
| 1-hydroxy-4-aminobutane 1,1 diphosphonic acid | OH | $—CH_2CH_2CH_2NH_2$ | 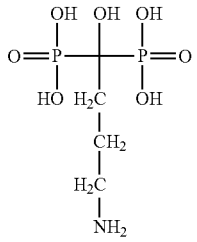 |

In accordance with the invention, from 1 to 10 moles of alkyl diphosphonic acid are mixed with one mole of one of the following acidic substances.

Suitable alkyl diphosphonic acids include, but not limited to, 1 hydroxyethane 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane 1,1 diphosphonic acid, 1-hydroxy-4-aminobutane 1,1 diphosphonic acid and the like.

Suitable acids include methanesulfonic acid, oxalic acid, lactic acid, citric acid, dodecylbenzenesulfonic acid, xylenesulfonic acid, toluenesulfonic acid, formic acid, tartaric acid, propionic acid, benzoic acid, ascorbic acid, gluconic acid, malic acid, malonic acid, succinic acid, gallic acid, butyric acid, trifluoracetic acid, phosphono formic acid, sulfamic acid, oxalic acid, hydroxy acetic acid, 2-amino ethane sulfonic acid, or fluoro boric acid and mixtures thereof.

The mixture or blend is adjusted to a pH of greater than 6 to about 10 with a buffering amount of basic compounds, such as potassium hydroxide, sodium hydroxide and metal ion free basic compounds consisting of an ammonium compound, such as e.g. ammonium hydroxide, tetraalkylammonium hydroxide (TMAH), tetraalkylammonium hydroxide pentahydrate (TMAH pentahydrate), benzyltetramethylammonium hydroxide (BTMAH), TBAH, choline hydroxide, or Tris(2-hydroxyethyl)methylammonium hydroxide (THEMAH), hydroxylamine freebase, a hydroxylamine derivative, such as e.g. N,N diethylhydroxylamine, an alkanolamine component including but not limited to hydrazine, ethylenediamine, monoethanolamine, N,N diethylamino ethanol, 2-(2-hydroxylethylamino)ethanol, 2-(2-aminoethoxy)ethanol, N,N,N-tris(2-hydroxyethyl)-ammonia, isopropanolamine, 3-amino-1propanol, 2-amino-1-propanol, 2-(N-methylamino)ethanol, 2-(2-aminoethylamino)ethanol, tris (hydroxymethyl)aminoethane, or mixtures thereof.

The basic buffering agent may be present in an amount from about up to about 25% by weight.

Preferrably the pH is from greater than 6 to about 10.

EXAMPLES

Example 1

The following is a list of blends as illustrated examples

TABLE

| For 1000 grams solution | | | | | | | |
|---|---|---|---|---|---|---|---|
| Comp. | Chemical | Mol Wt | Mole | Solute Mole | Solute Gram | Wt % | Wt ratio |
| 1 | 1-hydroxyethane diphosphonic acid | 206 | 6 | 0.69 | 142.1 | 14.21 | 3.79 |
| | Dodecylbenzenesulfonic acid | 326.5 | 1 | 0.115 | 37.55 | 3.75 | |
| | 25% TMAH water solution | | | | adjust to pH 6 | | |
| | Water | | | | Balance | | |
| | Total | | | | 1000 | | |
| 2 | 1-hydroxyethane diphosphonic acid | 206 | 6 | 0.69 | 142.1 | 14.21 | 9.96 |
| | Phosphono formic acid | 128 | 1 | 0.115 | 14.72 | 1.47 | |
| | 25% TMAH water solution | | | | adjust to pH 6 | | |
| | Water | | | | Balance | | |
| | Total | | | | 1000 | | |
| 3 | 1-hydroxyethane diphosphonic acid | 206 | 6 | 0.69 | 142.1 | 14.21 | 13.73 |
| | Oxalic acid | 90 | 1 | 0.115 | 10.35 | 1.04 | |

TABLE-continued

| For 1000 grams solution | | | | | | | |
|---|---|---|---|---|---|---|---|
| Comp. | Chemical | Mol Wt | Mole | Solute Mole | Solute Gram | Wt % | Wt ratio |
| | 65% tris(2-hydroxyethyl)methylammonium hydroxide (THEMAH) | | | | adjust to pH 9 | | |
| | Water | | | | Balance | | |
| | Total | | | | 1000 | | |
| 4 | 1-hydroxyethane diphosphonic acid | 206 | 6 | 0.69 | 142.1 | 14.21 | 12.74 |
| | Sulfamic acid | 97 | 1 | 0.115 | 11.16 | 1.12 | |
| | 45% choline hydroxide solution | | | | adjust to pH 9 | | |
| | Water | | | | Balance | | |
| | Total | | | | 1000 | | |
| 5 | 1-hydroxyethane diphosphonic acid | 206 | 6 | 0.69 | 142.1 | 14.21 | 16.26 |
| | Hydroxy acetic acid | 76 | 1 | 0.115 | 8.74 | 0.87 | |
| | N,N diethylhydroxylamine/monoethanolamine (1:1 wt ratio) | | | | adjust to pH 7 | | |
| | Water | | | | Balance | | |
| | Total | | | | 1000 | | |
| 6 | 1-hydroxyethane diphosphonic acid | 206 | 6 | 0.69 | 142.1 | 14.21 | 14.08 |
| | Fluoro boric acid | 87.8 | 1 | 0.115 | 10.1 | 1.01 | |
| | Ethylenediamine | | | | adjust to pH 10 | | |
| | Water | | | | Balance | | |
| | Total | | | | 1000 | | |
| 7 | 1-hydroxyethane diphosphonic acid | 206 | 6 | 0.69 | 142.1 | 14.21 | 85.24 |
| | 2-amino ethane sulfonic acid | 14.5 | 1 | 0.115 | 1.688 | 0.17 | |
| | 25% TMAH water solution | | | | adjust to pH 7 | | |
| | Water | | | | Balance | | |
| | Total | | | | 1000 | | |
| 8 | 1-hydroxyethane diphosphonic acid | 206 | 3 | 0.3 | 61.8 | 6.18 | 2.92 |
| | Hydroxy methylene phosphonic acid | 112 | 3 | 0.3 | 33.6 | 3.36 | |
| | Dodecylbenzenesulfonic acid | 326.5 | 1 | 0.1 | 32.65 | 3.27 | |
| | N,N diethylamino ethanol | | | | adjust to pH 7 | | |
| | Water | | | | Balance | | |
| | Total | | | | 1000 | | |
| 9 | 1-hydroxy-3-aminopropane 1,1 diphosphonic acid | 235 | 6 | 1.2 | 282 | 28.2 | 18.55 |
| | Hydroxy acetic acid | 76 | 1 | 0.2 | 15.2 | 1.52 | |
| | Tris(hydroxymethyl)amino ethane | | | | adjust to pH 9 | | |
| | Water | | | | Balance | | |
| | Total | | | | 1000 | | |
| 10 | Methylene diphosphonic acid | 176 | 6 | 0.69 | 121.4 | 12.10 | 8.64 |
| | 2-amino ethane sulfonic acid | 125 | 1 | 0.115 | 14.4 | 1.40 | |
| | 28% ammonium hydroxide solution | | | | adjust to pH 7 | | |
| | Water | | | | Balance | | |
| | Total | | | | 1000 | | |
| 11 | 1-hydroxyethane diphosphonic acid | 206 | 6 | 0.69 | 142.1 | 14.21 | 6.44 |
| | Citric acid | 192 | 1 | 0.115 | 22.08 | 2.21 | |
| | 65% (tris(2-hydroxyethyl)methylammonium hydroxide (THEMAH) | | | | adjust to pH 9 | | |
| | Water | | | | Balance | | |
| | Total | | | | 1000 | | |
| 12 | Hydroxy methylene diphosphonic acid | 112 | 6 | 0.69 | 67.2 | 6.72 | 2.06 |
| | Dodecylbenzenesulfonic acid | 326.5 | 1 | 0.1 | 32.65 | 3.27 | |
| | 25% TMAH water solution | | | | adjust to pH 10 | | |
| | Water | | | | Balance | | |
| | Total | | | | 1000 | | |

TABLE-continued

| For 1000 grams solution | | | | | | | |
|---|---|---|---|---|---|---|---|
| Comp. | Chemical | Mol Wt | Mole | Solute Mole | Solute Gram | Wt % | Wt ratio |
| 13 | 1-hydroxyethane diphosphonic acid | 206 | 6 | 0.69 | 142.1 | 14.21 | 16.26 |
| | Hydroxy acetic acid | 76 | 1 | 0.115 | 8.74 | 0.87 | |
| | 10% Potassium Hydroxide water solution | | | | adjust to pH 7 | | |
| | Water | | | | Balance | | |
| | Total | | | | 1000 | | |
| 14 | 1-hydroxyethane diphosphonic acid | 206 | 10 | 1.15 | 236.9 | 23.69 | 21.24 |
| | Sulfamic acid | 97 | 1 | 0.115 | 11.16 | 1.12 | |
| | 10% Potassium Hydroxide water solution | | | | adjust to pH 7 | | |
| | Water | | | | Balance | | |
| | Total | | | | 1000 | | |
| 15 | 1-hydroxyethane diphosphonic acid | 206 | 3 | 0345 | 71.07 | 7.11 | 8.13 |
| | Hydroxy acetic acid | 76 | 1 | 0.115 | 8.74 | 0.87 | |
| | 10% Potassium Hydroxide water solution | | | | adjust to pH 7 | | |
| | Water | | | | Balance | | |
| | Total | | | | 1000 | | |
| 16 | 1-hydroxyethane diphosphonic acid | 206 | 3 | 0.345 | 71.07 | 7.11 | 7.04 |
| | Fluoro boric acid | 87.8 | 1 | 0.115 | 10.1 | 1.01 | |
| | 10% Potassium Hydroxide water solution | | | | adjust to pH 10 | | |
| | Water | | | | Balance | | |
| | Total | | | | 1000 | | |
| 17 | 1-hydroxyethane diphosphonic acid | 206 | 1 | 0.115 | 23.69 | 2.37 | 14.21 |
| | 2 amino ethane sulfonic acid | 14.5 | 1 | 0.115 | 1.67 | 0.17 | |
| | 25% TMAH water solution | | | | adjust to pH 7 | | |
| | Water | | | | Balance | | |
| | Total | | | | 1000 | | |
| 18 | 1-hydroxyethane diphosphonic acid | 206 | 4 | 0.4 | 82.4 | 8.24 | 3.9 |
| | Hydroxyl methylene diphosphonic acid | 112 | 4 | 0.4 | 44.8 | 4.48 | |
| | Dodecylbenzenesulfonic acid | 326.5 | 1 | 0.1 | 32.65 | 3.27 | |
| | 65% (tris(2-hydroxyethyl)methylammonium hydroxide (THEMAH) | | | | adjust to pH 9 | | |
| | Water | | | | Balance | | |
| | Total | | | | 1000 | | |
| 19 | 1-hydroxyethane diphosphonic acid | 206 | 8 | 0.92 | 189.5 | 18.95 | 12.88 |
| | Phosphono formic acid | 128 | 1 | 0.115 | 14.72 | 1.47 | |
| | 25% TMAH water solution | | | | adjust to pH 7 | | |
| | Water | | | | Balance | | |
| | Total | | | | 1000 | | |
| 20 | 1-hydroxyethane diphosphonic acid | 206 | 8 | 0.92 | 189.5 | 18.95 | 18.31 |
| | Oxalic acid | 90 | 1 | 0.115 | 10.35 | 1.04 | |
| | 65% (tris(2-hydroxyethyl)methylammonium hydroxide (THEMAH) | | | | adjust to pH 9 | | |
| | Water | | | | Balance | | |
| | Total | | | | 1000 | | |
| 21 | Hydroxymethylene diphosphonic acid | 112 | 1 | 0.1 | 11.2 | 1.12 | 0.34 |
| | Dodecylbenzenesulfonic acid | 326.5 | 1 | 0.1 | 32.65 | 3.27 | |
| | 65% (tris(2-hydroxyethyl)methylammonium hydroxide (THEMAH) | | | | adjust to pH 10 | | |
| | Water | | | | Balance | | |
| | Total | | | | 1000 | | |

The pH adjustment indicates mid-range, for example adjusting to pH7 means about 6.5<pH<about 7.5; adjusting to pH8 means about 7.5<pH<about 8.5, etc.

This example illustrates the significance of the mole ratio of alkyl phosphonic acid to second acidic component in the cleaning composition of the present invention in reducing slurry particle remnants and metal ion remnants on the surface of a substrate.

Silicon oxide wafers were immersed for 30 seconds with copper-contaminated slurry. The oxide wafers were then washed with each of the above listed compositions and followed by rinsing in DI water. There was a complete and relatively fast dissolution of the remnants. Each of the blends removed the slurry particle remnants and metal ion from the surface of the substrates without attacking the exposed metal surfaces.

Example 2

The procedure was repeated with 5 parts of Composition 9 in 100 parts of D.I water (1:20 water dilution). Effectively, this solution contains 1.343% of 1-hydroxy-3 aminopropane 1,1diphosphonic acid and 0.122% of hydroxy acetic acid. It still maintains a 6:1 mole ratio of alky diphosphonic to second acidic compound. The same results were obtained by the use of this mixture.

Example 3

The procedure was repeated with 1 parts of Composition 5 in 100 parts of D.I water (1:100 water dilutions). Effectively, this solution contains 0.141% of 1-hydroxy ethanediphosphonic acid and 0.009% of hydroxy acetic acid. It still maintains 6:1 mole ratio of alky diphosphonic to second acidic compound. The same results were obtained by the use of this mixture.

Example 4

The procedure was repeated with 1 parts of Composition 15 in 100 parts of D.I water (1:100 water dilutions). Effectively, this solution contains 0.0711% of 1-hydroxy ethanediphosphonic acid and 0.009% of hydroxyl acetic acid. It still maintains 3:1 mole ratio of alky diphosphonic to second acidic compound. The same results were obtained by the use of this mixture.

Example 5

The procedure was repeated with 5 parts of Composition 14 in 100 parts of D.I water (1:20 water dilution). Effectively, this solution contains 1.185% of 1-hydroxy ethanediphosphonic acid and 0.056% of sulfamic acid. It still maintains a 10:1 mole ratio of alky diphosphonic to second acidic compound. The same results were obtained by the use of this mixture.

Example 6

| Ingredients | Trade name/ product name | Supplier | Wt (grams) | % |
|---|---|---|---|---|
| 1 hydroxyethane diphosphonic acid CAS #2809-21-4 | DEQUEST 2010 | Thermphos | 580 | 13.0% |
| Hydroxy acetic acid (70%) | Glycolic Acid | DuPont | 60 | 1.3% |
| Hydroxylamine Freebase (50%) | | San Fu | 600 | 13.4% |
| Triethanolamine (85%) | TEA85 | Dow | 470 | 10.5% |
| Water | | | 2760 | 61.7% |
| | | | 4470 | 100.0% |

The pH of the above solution is 7.24-7.26. The solution can be used as is or further diluted with water if necessary.

Example 7

| Ingredients | Trade name/ product name | Supplier | Wt (grams) | % |
|---|---|---|---|---|
| 1 hydroxyethane diphosphonic acid CAS #2809-21-4 | DEQUEST 2010 | Thermphos | 530 | 11.2% |
| Amino tris (methylene phosphonic acid) in water CAS # 6419-19-8 | DEQUEST 2000 | Thermphos | 90 | 1.9% |
| N,N Diethylhydroxylamine 85% CAS #3710-84-7 | | Arkema | 310 | 6.6% |
| Monoethanolamine | MEA | Dow | 310 | 6.6% |
| Water | | | 3480 | 73.7% |
| | | | 4720 | 100.0% |

The solution has a pH of 7.7. The solution can be used as is or further diluted with water if desired.

It will be obvious to any skill in the art that the effectiveness of removing particle and metal ion contaminant will depend on the seriousness of the problem. A higher concentration of the blended composition will produce faster results.

The composition of the embodiments herein do not sequest and there is no dead or nonperformance zone of cleaning.

The alky diphosphonic acid acts as a chelating agent throughout a large concentration range, starting with a few parts to million parts water.

In another embodiment, the composition contains a surfactant which synergistically enhances the cleaning performance of the composition over the composition with alkyl diphosphonic acid alone.

Preferably a surfactant is admixed with the blend to both keep it from re-precipitating and to enhance the cleaning ability of the composition. There are several types of surfactants available. Readily available and relatively inexpensive surfactants include anionic, cationic, non-ionic, amphoteric, or polyacrylic acid, water-soluble salts of polyacrylic acid, hydrolyzed poly-maleic anhydride, or water-soluble salts of polyacrylic acid.

While the embodiments have been described and illustrated herein by reference to various specific materials, procedures and examples, it is understood that the invention is not restricted to the particular combinations of materials and procedures selected for that purpose. Numerous variations of such details can be implied as will be appreciated by those skilled in the art. It is intended that the specification and examples considered as exemplary, only, with the true scope and spirit of the invention being indicated by the following claims. All references, patents, patent applications referred to in this application are herein being incorporated by reference in their entirety.

What is claimed is:

1. A method of cleaning semiconductor substrates comprising the steps of:

a. providing a substrate having a surface comprising copper-containing conductor and a low-k dielectric material and one or more of etching residue, planarization residue, and copper oxide disposed on the surface, which generated from a damascene or dual damascene manufacturing processes or thereof;

b. contacting the surface of the substrate with an effective amount of an aqueous cleaning solution, for a time and at a temperature sufficient to remove residue and/or copper oxide, wherein the solution comprises:

i. from about 6 wt % to about 30 wt % of an alkyl diphosphonic acid of the basic structure:

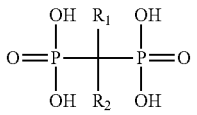

wherein $R_1$ and $R_2$ are either the same or different and select from the group consisting of hydrogen (H), hydroxide (OH), chloride (Cl), alkyl or aryl having between 1 to about 8 carbon atoms and alkyl or aryl amine;

ii. a second acidic compound is selected from the group consisting of; phosphonoformic acid, sulfamic acid, and fluoroboric acid;

iii. a buffering amount of one or more basic compounds to adjust pH from about 6 to about 10;

iv. from 0% by weight and up to 5% by weight of a surfactant; and v. water;

wherein the cleaning process is following chemical mechanical planarization step during the semiconductor fabrication processes;

wherein the mole ratio of alkyl diphosphonic acid to second acidic compound is from about 1:1 to about 10:1.

2. The method according to claim 1 in which the alkyl disphosphonic is selected from the group consisting of 1 hydroxyethane 1,1 diphosphonic acid, methylene disphosphonic acid, hydroxymethylene diphosphonic acid, dichloromethylene disphosphonic acid, hydroxycyclohexylmethylene disphosphonic acid, 1-hydroxy-3-aminopropane 1,1 diphosphonic acid, 1-hydroxy-4-aminobutane 1,1 diphosphonic acid and mixtures thereof.

3. The method according to claim 1 further comprising an additional acid selected from the group consisting of dodecylbenzenesulfonic acid, xylenesulfonic acid, toluenesulfonic acid, 2-amino ethane sulfonic acid, and an organic carboxylic acid.

4. The method according to claim 3 in which the organic carboxylic acid is selected from the group consisting of oxalic acid, lactic acid, citric acid, formic acid, tartaric acid, propionic acid, benzoic acid, ascorbic, acid, gluconic acid, malic acid, malonic acid, succinic acid, gallic acid, butyric acid, trifluoracetic acid and mixtures thereof.

5. The method according to claim 1 in which the buffering base is selected from the group consisting of potassium hydroxide, sodium hydroxide and metal ion free base and mixture thereof.

6. The method according to claim 5 in which the buffering metal ion free base is at least one basic compounds selected from the group consisting of hydroxylamine freebase or a hydroxylamine derivative, tetraalkylammonium hydroxide, TMAH pentahydrate, BTMAH (benzyltetramethylammonium hydroxide), TBAH, choline, or THEMAH (Tris(2-hydroxyethyl)methylammonium hydroxide)), monoethanolamine, 2-(2-hydroxylethylamino)ethanol, 2-(2-aminoethoxy) ethanol, N,N,N-tris(2-hydroxyethyl)-ammonia, isopropanolamine, 3-amino-1-propanol, 2-amino-1-propanol, 2-(N-methylamino)ethanol, 2-(2-aminoethylamino) ethanol, tris(hydroxymethyl)aminoethane, or mixtures thereof.

7. The method according to claim 1 wherein the pH is adjusted to be from greater than 6 to about 8.

8. The method of claim 1 wherein the surfactants are selected from the group consisting of anionic, cationic, non-ionic, amphoteric or polyacrylic acid, water-soluble salts of polyacrylic acid, hydrolyzed poly-maleic anhydride, or water-soluble salts of polyacrylic acid.

9. The method of claim 1, wherein the aqueous cleaning solution is further diluted with DI water at dilution ratios from at least 1:1 to about 1:500.

* * * * *